United States Patent [19]

Holce et al.

[11] 4,392,707

[45] Jul. 12, 1983

[54] TAKE-OFF CONNECTOR FOR SECURITY CIRCUIT

[75] Inventors: Thomas J. Holce, Portland; Charles M. Huckins, Tigard, both of Oreg.

[73] Assignee: Sentrol, Inc., Portland, Oreg.

[21] Appl. No.: 264,572

[22] Filed: May 18, 1981

[51] Int. Cl.[3] ..... H01R 13/54; G08B 13/08

[52] U.S. Cl. ..... 339/125 R; 200/61.81; 200/61.71; 340/545

[58] Field of Search ..... 339/17 T, 125 R; 340/545; 200/61.62, 61.71, 61.81, 283

[56] References Cited

U.S. PATENT DOCUMENTS 3,541,287 11/1970 Wilson et al. ..... 200/283

4,151,382 4/1979 Kaufman et al. ..... 200/61.71

*Primary Examiner*—Eugene F. Desmond

*Attorney, Agent, or Firm*—Chernoff, Vilhauer, McClung, Birdwell & Stenzel

[57] ABSTRACT

A take-off connector for connecting part of a security system electrical circuit, such as a metal foil strip conductor mounted on a movable portion of a window to detect breakage of the window glass, to a fixedly mounted portion of the circuit. The separate portions of the take-off connector may be mounted in a plurality of positions relative to one another and include provisions for connecting electrical conductors alternatively on a side which is parallel to or perpendicular to a surface against which that portion of the connector is mounted. Movable contacts are bifurcated flat springs and include convex contact points, while flat fixed contact surfaces are provided on each of two sides of one portion of the connector.

8 Claims, 11 Drawing Figures

TAKE-OFF CONNECTOR FOR SECURITY CIRCUIT

BACKGROUND OF THE INVENTION

The present invention relates to improvements in take-off connectors for joining portions of circuits mounted on movable objects to portions of circuits which are stationary, and particularly to an improved take-off connector for use in electrical circuits in systems for monitoring physical security of buildings.

False alarms are one of the primary problems with electrically operated security systems. One common type of intrusion detection system for protecting windows uses an electrically conductive foil strip attached to the window as a part of a circuit which must remain intact to provide an indication of normal conditions. Whenever circuit continuity is broken, as when the window is broken, breaking the foil strip, the alarm controller senses an abnormal condition and provides an appropriate alarm. Loss of contact between the window-carried portion of such a circuit and the rest of the circuit, however, produces a false alarm.

To avoid false alarms it is necessary for such a circuit to use a take-off connector which reliably connects the movable window-carried portion of the circuit to the remainder of the circuit. Such a take-off connector should not develop an increasing resistance through its contact points, despite either frequent opening and closing of the window or long periods without being checked, and should properly connect the window-carried portion of the circuit to the stationary portion of the circuit without any special effort besides moving the window.

Because of the numerous different designs for the frames of movable windows it is desirable for the separate movable and stationary portions of such a take-off connector to be mountable for operation in more than one arrangement. It is also desirable for such a take-off connector to be operable by longitudinal sliding of the movable portion relative to the stationary position to permit alarm system actuation with a window in a permissible partly open position.

One type of previously known take-off connector includes small helical springs which urge pivotably mounted movable contact points toward fixed contact surfaces on the opposite portion of the take-off connector. Conductors are connected to the moving contact portion of such a connector at terminal posts connected to the helical springs. The electrical path extends through the helical springs and thence into the movable contact points. Circuit continuity in this type of take-off connector depends thus upon maintenance of good electrical contact between the spring and the contact point. There are, then, at least two locations in each electrical path through such a take-off connector where dirt or corrosion may build up to eventually interrupt the electrical path.

To reduce the possibility of such an interruption of the electrical circuit such take-off connectors commonly utilize a relatively high spring force (as much as five pounds for full depression of the movable contacts) to maintain an electrical path between the parts of the connector. This amount of force is unsuitable in an arrangement where one portion of the take-off connector slides along the other, because the force of the springs may be sufficient to lift the window frame from its proper position in its slide track, and because of the amount of contact surface wear likely to result. High spring force also makes adhesive mounting of such previously known connectors impractical.

Another known type of take-off connector utilizes a sheet metal flat spring as the movable contact. The movable contacts of such a connector each have an end shaped in a convex arc providing a line of contact against a flat fixed contact surface on the opposite portion of the take-off connector. The only commercially available take-off connectors of this type known to the applicants, however, utilize a significantly high spring force, making the unit at best marginally suitable for sliding, rather than directly approaching face to face contact. Additionally, these movable contacts have an exposed free end which is subject to being caught on one's clothing, causing the contact to bend out of alignment or to damage the clothing.

One known connector has a pair of narrow movable contact points of the resilient flat spring type mounted side by side, with the ends of the contacts protected. This arrangement of the contacts has the disadvantage that misalignment of the two portions of the connector, resulting, for instance, from a loose fit of a movable window, may result in an excessive number of false alarms.

What is needed, therefore, is an improved take-off connector for use in connecting a window-carried portion of a security circuit to a stationary portion of such a security circuit in connection with a wide variety of types of window frame arrangements, wherein the connector is usable in either a sliding or a face-to-face approach of the movable and stationary connector portions to one another, in which significant amount of misalignment is easily accommodated, and which operates reliably over long periods of time.

SUMMARY OF THE INVENTION

The present invention overcomes the above-described shortcomings and disadvantages of previously known take-off connectors for security circuits by providing a take-off connector in which each conductor of the security circuit is held in direct physical contact with a respective contact element of the connector. Simple pressure of a movable contact point against a contact surface is used at only one point in each electrical path through the take-off connector.

A spring-biased movable contact of the take-off connector of the invention includes a pair of contact points which move independently, providing contact with the corresponding fixed contact of the opposite portion of the take-off connector despite significant misalignment. Each movable contact point has a convex surface, thus assuring relatively high contact pressure despite a low spring force. All of the contacts may be gold plated to resist corrosion and provide low resistance connections for a long period.

The fixed contacts of the take-off connector are preferably mounted on the movable frame of a window or sliding glass door as the movable portion of the take-off connector. The movable portion may be mounted optionally with conductor terminals for connection to the glass-mounted foil portion of the circuit either on a side extending away from the glass or parallel and spaced apart from it. In either position it exposes contact surfaces for electrical contact with the other portion of the take-off connector, since each of the fixed contacts extends to two sides of the movable portion. In a preferred embodiment of the take-off connector of the invention, the contact surfaces of a pair of fixed contacts are approximately flush with a flat surface of the contact-carrying member, facilitating sliding movement of the contact-carrying member lengthwise along the movable contact unit of the connector.

The other, preferably stationary, portion of the take-off connector includes a housing which protectively covers and properly supports a pair of spring contacts which are each bifurcated to provide a pair of elongated parallel contact points. Each contact point is free to move independently into and out of the housing through a respective contact aperture, with the housing protecting the free end of each contact point. Connection terminals are provided to allow conductor leads to be connected directly to a base portion of each bifurcated spring contact so that the only electrical connection which must be maintained merely by spring contact pressure is that directly between the contact points of the spring contacts and the contact surfaces of the fixed contacts.

It is therefore a primary objective of the present invention to provide a take-off connector which will provide reliable operation throughout a long period of use in a security system electrical circuit.

It is another important objective of the present invention to provide such a take-off connector which will operate either in face-to-face directly approaching movement of the portions of the connector, or by lengthwise sliding movement of one portion of the connector relative to the other.

It is a principal feature of the take-off connector of the present invention that it includes a bifurcated spring contact which provides reliable electrical contact with the non-movable contact surface of the opposite portion of the take-off connector despite slight misalignment of the take-off connector portions with respect to one another.

It is another important feature of the present invention that it provides apertures to accept fasteners for mounting the fixed contacts to a surface in either of at least two positions, permitting convenient access to terminals for connection of the conductors to the unit in a choice of positions.

It is a further feature of the take-off connector of the present invention that it includes bifurcated spring contacts which utilize a low spring force and a convex contact point to provide relatively high contact pressure and thereby establish reliable electrical connection between portions of the take-off connector without lifting a sliding window from its normal position in its track.

It is a principal advantage of the present invention that it provides a take-off connector which can be used conveniently on a wider variety of different types of window frame and sliding glass door arrangements than previously known take-off connectors.

The foregoing and other objectives, features and advantages of the present invention will be more readily understood upon consideration of the following detailed description of the invention taken in conjunction with the accompanying drawings.

DETAILED DESCRIPTION OF THE INVENTION

Figure 1:
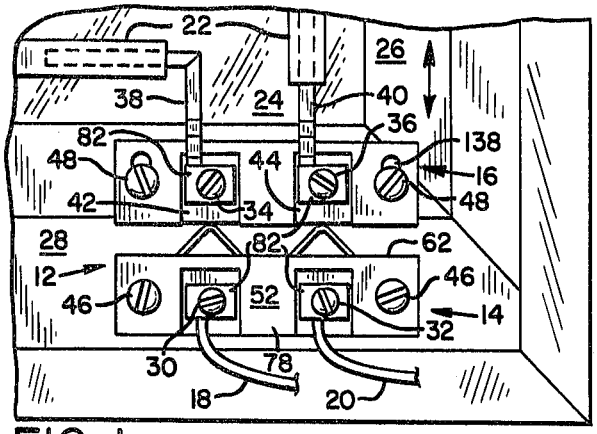
FIG. 1 is a pictorial view of an exemplary take-off connector according to the present invention installed on a window.

Referring now to FIG. 1 of the drawings, the take-off connector 12 of the present invention includes a stationary portion 14 and a movable portion 16 incorporated in a security system electrical circuit. The take-off connector 12 electrically connects fixedly installed conductors 18 and 20 of the security system circuit to a movable portion of the circuit which includes a loop of metal foil strips 22, adhesively mounted against the glass 24 of a sliding window whose frame 26 is mounted slidably within a track 28.

The security system circuit conductors 18 and 20 are fastened to the stationary portion 14 of the take-off connector 12 by terminal post screws 30 and 32. Similarly, terminal post screws 34 and 36 fasten respective take-off strips 38 and 40 to the fixed contacts 42 and 44 of the movable portion 16 of the take-off connector 12. Mounting screws 46 hold the stationary portion 14 to the window track 28, and mounting screws 48 hold the movable portion 16 to the window frame 26. It will, however, be appreciated that the movable portion 16 could be used as the stationary portion and the stationary portion 14 could be attached to the movable frame 26, and the designations of movable and stationary portions as used herein are for the purpose of reference.

Figure 2:
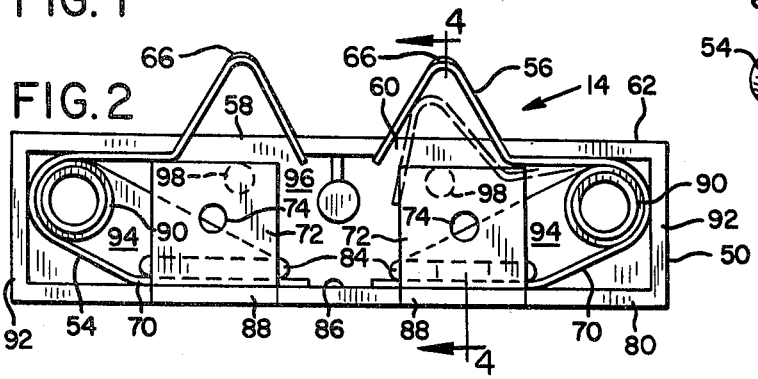
FIG. 2 is a side elevational view, at an enlarged scale, of the contact housing and spring contacts of the take-off connector shown in FIG. 1, with the cover of the contact housing removed.

Referring now also to FIGS. 2–6, the stationary portion 14 comprises a contact housing 50, shown in FIG. 2 with its cover 52 removed to expose a pair of movable bifurcated spring contacts 54 and 56 located therein. Each spring contact 54 and 56 is preferably made of a thin metal sheet and plated with gold to prevent corrosion and promote electrical conductivity. A pair of contact exposing apertures 58 and 60 are located on a first elongate side 62 of the contact housing 50, permitting part of each spring contact 54 and 56 to extend outward through the contact housing 50 beyond the plane of the side 62.

Figure 5:
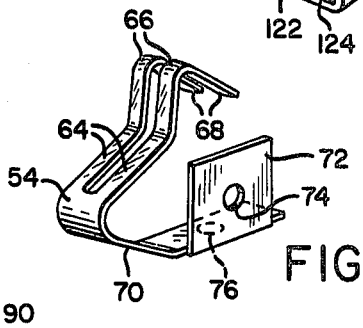
FIG. 5 is a pictorial view of one of the spring contacts of the take-off connector shown in FIG. 1, at an enlarged scale.

As may be seen in FIG. 5, showing the spring contact 54 removed from the contact housing 50, each spring contact 54 and 56 comprises a pair of resiliently flexible convexly arcuate contact points 64. Each contact point 64 has a generally "U"-shaped portion 66 and a free end 68. The take-off connector 12 thus provides two possible parallel electrical connection paths between the movable portion 16 and the stationary portion 14, for each leg of the security system circuit.

A base portion 70 of each spring contact 54 and 56 extends away from the contact points 64 and thence curves beneath the contact points 64. A tab 72 extends perpendicularly from one lateral edge of the base portion 70 in the spring contact 54 and from the opposite lateral edge of the base portion 70 in the spring contact 56. An aperture 74 is provided in the tab 72, while an aperture 76 is provided in the base portion 70, to receive the terminal post screws 30 and 32 to permit the conductors 18 and 20 to be connected to the spring contacts 54 and 56 in a position, relative to the first side 62, on either an adjacent side 78 or the opposite side 80 of the stationary portion 14.

Figure 3:
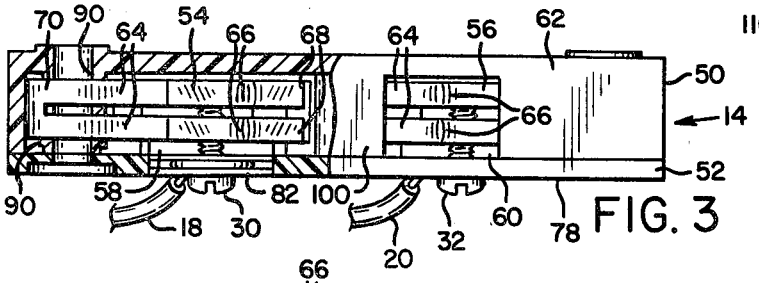
FIG. 3 is a partially cut-away top view of the contact housing and spring contacts ot the take-off connector shown in FIG. 1, at an enlarged scale.
Figure 8:
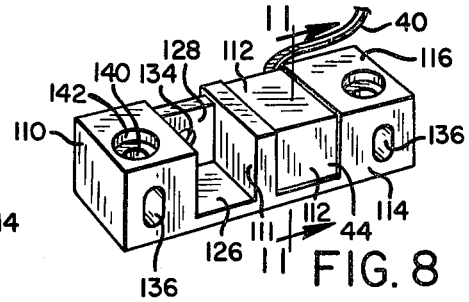
FIG. 8 is a pictorial view of the contact-carrying member of the movable portion of the take-off connector shown in FIG. 7, with one of the fixed contacts thereof removed.
Figure 4:
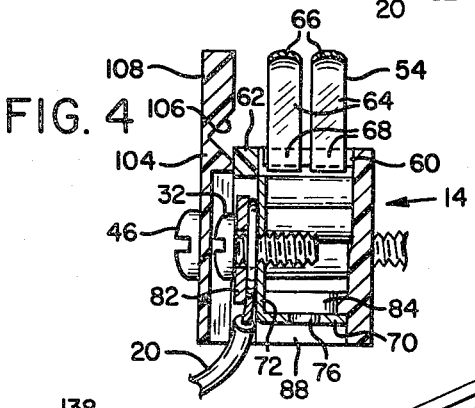
FIG. 4 is a sectional view, taken along line 4—4 of FIG. 2, of the contact housing and spring contacts of the take-off connector shown in FIG. 2, with an optional protective guard plate installed thereon.
Figure 7:
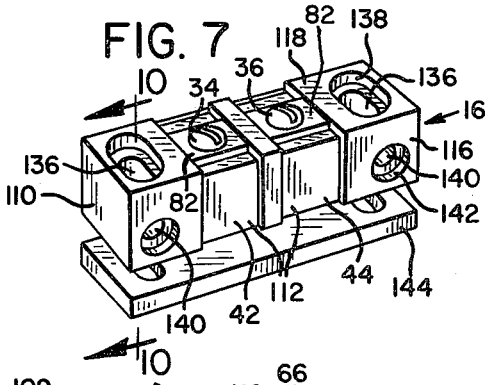
FIG. 7 is a pictorial view of the movable portion of the take-off connector shown in FIG. 1, along with a mounting spacer therefor.
Figure 6:
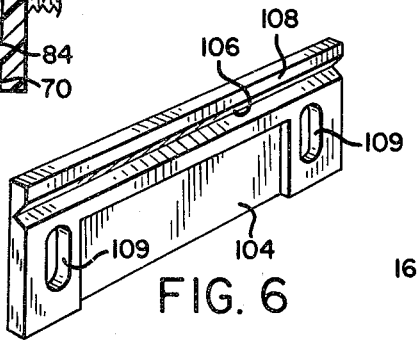
FIG. 6 is a pictorial view of a guard plate usable with the stationary portion of the take-off connector shown in FIG. 1, at an enlarged scale.
Figure 10:
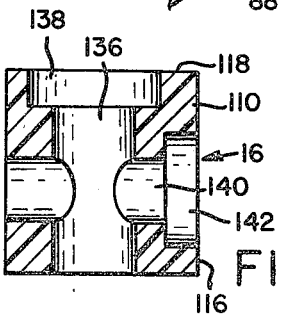
FIG. 10 is a sectional view, taken along line 10—10, of the movable portion shown in FIG. 7.
Figure 11:
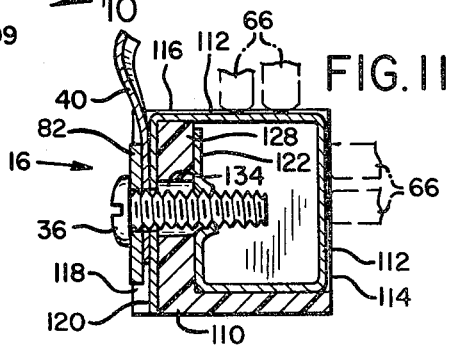
FIG. 11 is a sectional view of the movable portion shown in FIG. 8, taken along line 11—11.

Preferably the conductors 18 and 20 are connected to the respective spring contacts 54 and 56 by being clamped between a small apertured rectangular clamping plate 82 and the spring contact 54 or 56, as may be seen in FIGS. 3 and 4. The conductor 18 or 20 thus contacts the surface of the respective spring contact 54 or 56 directly. This ensures the best possible electrical conductivity, short of soldering the connection, at the point of connection of the electrical conductor to the spring contact.

It may be seen in FIG. 4 that the "U"-shaped central portion 66 of each contact point 64 is arcuate in cross-section. This provides a convex surface which concentrates pressure where the contact point 64 touches the respective fixed contact 42 or 44 of the movable portion 16 of the take-off connector 12. Reliable connection is provided with spring force requiring less than 1½ pounds to depress all four of the contact points 64 to a position flush with the first side 62 of the contact housing 50. The convex curvature of the contact point 64 also permits it to slide laterally, perpendicular to the length of the spring contact 54 or 56, on the fixed contact 42 or 44, to accommodate some looseness of the window frame 26 in the track 28.

Within the contact housing 50, each spring contact 54 and 56 fits with its base portion 70 supported by a support block 84 and an interior wall surface 86 which defines a pair of openings 88 exposing the base portion 70 and permitting installation of one of the terminal post screws 30 or 32. The base portion 70 of each spring contact 54 or 56 extends diagonally away from the interior wall surface 86 and thence between a cylindrical mounting screw tube 90 and a respective end wall 92 of the contact housing 50. The mounting screw tube 90 provides some support for the spring contact 54 or 56 as it flexes from the position shown in solid line in FIG. 2 to a depressed position such as that indicated in broken line in FIG. 2.

A corner portion 94 at each end of the interior of the contact housing is slightly raised with respect to the remainder of the rear wall 96 of the contact housing, ensuring side clearance for movement of the spring contacts. A pair of posts 98 extend away from the rear wall 96 of the housing 50 at a position aligned with the center of the "U"-shaped portion 66 of each contact point 64 to prevent the spring contacts from being forced too far within the housing, and to prevent the tabs 72 from being bent into a position of interference with movement of the contact points 64. A central portion 100 prevents the spring contacts from accidentally being forced into contact with one another and retains the free ends 68 within the contact housing.

The cover 52 ordinarily encloses the contact housing 50 and may be adhesively attached to edge surfaces of the contact housing 50. A guard plate 104, shown in FIGS. 4 and 6, may be used to protectively cover the stationary portion 14, protecting the terminal post screws 30 and 32 from undesired contact. A groove 106 defined in the guard plate 104 permits an upper portion 108, ordinarily available to protect the spring contacts, to be broken off. The guard plate 104 can then be used as a simple spacer where necessary in order to mount the stationary portion 14 in proper alignment with the movable element 42. The guard plate 104 includes elongated holes 109 located to align with the mounting screw tubes 90 when the guard plate 104 is in position over the cover 52.

Referring now to FIGS. 7–11, the movable portion 16 may be seen to comprise a contact carrying member 110 which is generally rectangular in shape and is made of insulating material. The pair of fixed contacts 42 and 44 are located in respective recesses 111 spaced apart from one another along the length of the contact carrying member 110. Each fixed contact 42 and 44 has a pair of flat contact surfaces 112 exposed flush with or slightly below the surfaces of the contact carrying member 110, on each of two elongate sides 114 and 116 of the contact carrying member 110. On a third side 118 of the contact carrying member 110, the respective terminal post screws 34 and 36 and associated clamping plates 82 are located.

Figure 9:
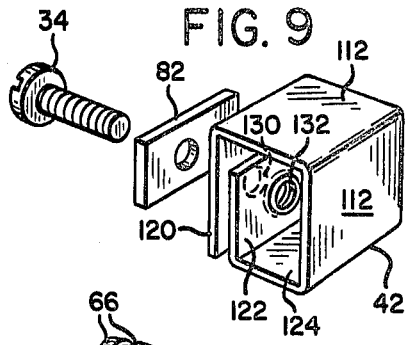
FIG. 9 is a pictorial view of one of the fixed contacts from the movable portion shown in FIG. 7, at an enlarged scale.

As may be seen in FIG. 9, each fixed contact 42 and 44 is in the form of a flat strip of material having four inward angles along parallel lines to present the two flat contact surfaces 112. Two end segments 120 and 122 overlap one another and are spaced slightly apart. The spacing between the overlapping ends 120 and 122 permits the fixed contact 42 or 44 to be placed with one end on each of two opposite sides of a respective contact mounting element 128 of the contact carrying member 110. Another flat segment 124 fits against a corresponding surface 126 of the contact carrying member 110.

A hole 130 in the outer overlapping end 120 is slightly larger than the diameter of the terminal post screws 34 and 36 while a hole 132 in the inner overlapping end is threaded to receive the respective terminal post screw 34 or 36. A contact attachment aperture 134 is also provided in each contact mounting element 128 in a position aligned with the holes 130 and 132 in the fixed contact 42 or 44.

The fixed contacts 42 and 44, like the spring contacts 54 and 56, are preferably made of thin sheet metal with a plating of gold to promote conductivity and resist corrosion.

On the elongate side 118 of the contact carrying member on which the terminals are located an elongated mounting screw hole 136 is provided at each end of the contact carrying member. A portion 138 of the mounting screw hole is enlarged to permit the head of a mounting screw 48 to be countersunk.

A second pair of mounting screw holes 140 extends from the elongate side 114 of the contact carrying member, intersecting the elongated mounting screw holes 136. Each mounting screw hole 140 is also provided with an enlarged recess 142 for receiving the head of a mounting screw 48. A spacer plate 144 is provided to facilitate mounting the movable portion 16 on a window frame 26 in proper alignment with the stationary portion 14 when it is mounted, for example, on the slide track 28. The spacer plate 144 also insulates the fixed contacts from a conductive mounting surface where necessary, as when using the elongated mounting screw holes 136.

Provision of two pairs of perpendicularly intersecting mounting screw holes permits the movable portion 16 to be mounted alternatively with the side 118 extending perpendicular from, or parallel with and spaced apart from a surface such as a window frame 26. The take-off connector 12 of the invention can be installed either against the surface or let into the edge of a window frame 26, with the respective terminals and contacts available in any of a variety of positions depending on the configuration of the window or sliding door on which the take-off connector is mounted.

Each conductor 18, 20, or 22 of the security system electrical circuit may be connected to the respective fixed contact in direct contact therewith, providing the best possible electrical connection. Tightening the terminal post screw 34 or 36 when connecting a security system circuit conductor to the fixed contact 42 or 44 also secures the fixed contact 42 or 44 to the contact mounting element 128 in the proper position to permit relative movement of the movable portion 16 lengthwise of the stationary portion 14. The convexly curved shape of each contact point 64, and the light spring force permit this longitudinal sliding motion without damage to the spring contacts.

The take-off connector 12 of the invention may be mounted preferably with the stationary portion 14 located on the window slide track 28 and the movable portion 16 mounted on the movable window frame 26. The contact surfaces 112 of the fixed contacts 42 and 44 should be aligned with the contact points 64 of the spring contacts, depressing them approximately $\frac{1}{8}$ of an inch when the window is in its properly closed position. This requires a total force between the portions of the take-off connector 12 of about one pound or less. While use of mounting screws 46 and 48 is usually preferred, the light spring force of the spring contacts 54 and 56 makes it practical to mount the take-off connector 12 using double faced adhesive tape (not shown) if desired.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A take-off connector for use in a security system electrical circuit for connecting a stationary conductor of said security system circuit with a conductor of said circuit which is carried on a movable object such as a slidable window and the like, said take-off connector comprising:

(a) a contact carrying member having at least two mutually perpendicular sides and a third side and defining a plurality of recesses located in one of said mutually perpendicular sides for receiving the respective ones of a plurality of fixed contacts, said contact carrying member including a contact mounting element defining a contact attachment aperture;

(b) a plurality of fixed contacts located spaced apart from one another on said contact carrying member, each of said fixed contacts including a contact surface associated with and located substantially flush with at least two of said mutually perpendicular sides of said contact carrying member and each of said fixed contacts comprising an elongate strip of conductive material including a plurality of inwardly directed angles defining a plurality of interconnected segments including said contact surfaces, a pair of said segments being arranged to fit on opposite sides of said contact mounting element and each segment of said pair including aperture means for receiving a terminal post screw;

(c) first terminal means located on each of said fixed contacts for electrically connecting a conductor of said security system electrical circuit directly thereto, said first terminal means being located on said third side of said contact carrying member;

(d) means for mounting said contact carrying member on a mounting surface, alternatively with said third side extending away from said mounting surface or with said third side spaced apart from said mounting surface;

(e) a contact housing including a first side thereof and defining a plurality of contact exposing apertures located on said first side thereof in spaced apart relationship;

(f) means for mounting said contact housing on a surface;

(g) a plurality of bifurcated spring contacts each including a pair of resiliently flexible convexly arcuate contact points, each contact point having a generally "U"-shaped portion and a free end, said free end being located within said contact housing;

(h) supporting means, included in said contact housing, for holding each said bifurcated spring contact with said "U"-shaped portion of each contact point protruding outwardly from said housing through a respective one of said contact exposing apertures to contact a respective one of said contact surfaces; and (i) second terminal means located on each said bifurcated spring contact for electrically connecting a conductor of said security system electrical circuit directly thereto.

2. The take-off connector of claim 1 wherein said convexly arcuate contact points comprise elongate strips of resiliently flexible electrically conductive sheet material, the "U"-shaped portion of each contact point including a surface which is convex as seen both along and across the length of said contact point.

3. The take-off connector of claim 1, said fixed contact and said bifurcated spring contact each being a unitary piece of electrically conductive material.

4. The take-off connector of claim 1 wherein each of said contact surfaces and said contact points has a coating of gold.

5. A take-off connector for use in a security system electrical circuit for connecting a stationary conductor of said security system circuit with a conductor of said circuit which is carried on a movable object such as a slidable window and the like, said take-off connector comprising:

(a) a contact carrying member;
(b) a fixed contact located on said contact carrying member;
(c) first terminal means located on said fixed contact for electrically connecting a conductor of said security system electrical circuit to said fixed contact;
(d) a contact housing including a first side defining a contact exposing aperture;
(e) a bifurcated spring contact including a pair of resiliently flexible convexly arcuate contact points, each said contact having a generally "U"-shaped portion;
(f) supporting means, included in said contact housing, for holding said bifurcated spring contact with said "U"-shaped portion of each contact point protruding outwardly from said housing through said contact exposing aperture;
(g) second terminal means located on said bifurcated spring contact for electrically connecting a conductor of said security system electrical circuit to said bifurcated spring contact;
(h) each one of said pair of contact points comprising an elongate strip of said resiliently flexible electrically conductive material and said "U"-shaped portion including a surface which is arcuately convex as seen both along and across the length of said contact point, the smallest dimension of said contact point being in a direction substantially normal to said surface, and the dimension of said contact point in a direction substantially tangent to said surface of said convex portion and across the length of said contact point being significantly greater than said smallest dimension; and
(i) means for mounting said contact carrying member and said contact housing in respective locations where movement of said slidable window and the like brings said contact points into contact with said fixed contact.

6. The take-off connector of claim 5, comprising:
(a) a plurality of said fixed contacts, said fixed contacts being located spaced apart from one another on said contact carrying member; and
(b) a plurality of said bifurcated spring contacts located in said contact housing, said contact housing including a plurality of said contact exposing apertures located on said first side thereof in spaced apart relationship corresponding to the distance by which said fixed contacts are spaced apart from one another on said contact carrying member, and said "U"-shaped portions of each pair of contact points protruding outwardly through a respective one of said contact exposing apertures.

7. The take-off connector of claim 5, said fixed contact and said bifurcated spring contact each being a unitary piece of conductive material.

8. A take-off connector for use in a security system electrical circuit for connecting a stationary conductor of said security system circuit with a conductor of said circuit which is carried on a movable object such as a slidable window and the like, said take-off connector comprising:
(a) a contact carrying member having a side and defining a recess located in said side for receiving a fixed contact;
(b) a fixed contact including a contact surface located substantially flush with said side of said contact carrying member;
(c) first terminal means located on a portion of said fixed contact for electrically connecting a conductor of said security system electrical circuit directly to said fixed contact;
(d) a contact housing including a first side defining a contact exposing aperture;
(e) means for mounting said contact carrying member and said contact housing for relative movement toward and away from one another in response to movement of an object such as a slidable window and the like;
(f) a bifurcated spring contact of electrically conductive sheet material including a pair of resiliently flexible convexly arcuate contact points, each contact point having a generally "U"-shaped central portion and a free end, said free end being located within said contact housing;
(g) supporting means, included in said contact housing, for holding said bifurcated spring contact with said "U"-shaped portion of each contact point protruding outwardly from said housing through said contact exposing aperture;
(h) second terminal means located on said bifurcated spring contact for electrically connecting a conductor of said security system electrical circuit directly to said bifurcated spring contact; and
(i) each of said pair of contact points comprising an elongate strip of said resiliently flexible electrically conductive sheet material, said "U"-shaped portion including a surface which is arcuately convex as seen both along and across the length of said contact point, said surface facing toward said fixed contact, the smallest dimension of said contact point being in a direction substantially normal to said surface and the dimension of said contact point in a direction substantially tangent to said surface of said convex portion and across the length of said contact point being significantly greater than said smallest dimension.

* * * * *

UNITED STATES PATENT AND TRADEMARK OFFICE

CERTIFICATE OF CORRECTION

PATENT NO. : 4,392,707

DATED : July 12, 1983

INVENTOR(S) : THOMAS J. HOLCE and CHARLES M. HUCKINS

It is certified that error appears in the above-identified patent and that said Letters Patent is hereby corrected as shown below:

| | | |
|---|---|---|
| Title | | After "SECURITY" add --SYSTEM--. |
| Col. 4 | Line 6 | Change "ot" to --of--. |
| Col. 9 | Line 12 | After "contact" insert --point--. |

Signed and Sealed this

*Twenty-seventh* Day of *November 1984*

[SEAL]

*Attest:*

GERALD J. MOSSINGHOFF

*Attesting Officer*

*Commissioner of Patents and Trademarks*